US012392355B2

(12) United States Patent
Gross et al.

(10) Patent No.: US 12,392,355 B2
(45) Date of Patent: Aug. 19, 2025

(54) FLUID PUMP

(71) Applicant: MAHLE INTERNATIONAL GMBH, Stuttgart (DE)

(72) Inventors: Martin Gross, Kämpfelbach (DE); Uwe Aschermann, Karlsruhe (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 34 days.

(21) Appl. No.: 18/406,685

(22) Filed: Jan. 8, 2024

(65) Prior Publication Data

US 2024/0229825 A1 Jul. 11, 2024

(30) Foreign Application Priority Data

Jan. 10, 2023 (DE) ..... 102023200129.2

(51) Int. Cl.

| | |
|---|---|
| ***F04D 29/58*** | (2006.01) |
| ***F04D 1/00*** | (2006.01) |
| ***F04D 25/06*** | (2006.01) |
| ***F04D 29/42*** | (2006.01) |

(52) U.S. Cl.

CPC ..... *F04D 29/5806* (2013.01); *F04D 1/00* (2013.01); *F04D 25/06* (2013.01); *F04D 29/4226* (2013.01)

(58) Field of Classification Search

CPC ..... F04D 29/5806; F04D 1/00; F04D 25/06; F04D 29/4226; F04D 25/082; F04D 13/06; F04D 29/586

See application file for complete search history.

(56) References Cited

U.S. PATENT DOCUMENTS

| | | | | |
|---|---|---|---|---|
| 4,531,357 | A * | 7/1985 | Weber | F02C 7/185 60/39.83 |
| 7,459,817 | B2 * | 12/2008 | VanLuik | H02K 5/128 310/90 |
| 7,462,964 | B2 * | 12/2008 | Nagayama | H02K 9/06 310/58 |
| 8,080,909 | B2 * | 12/2011 | Perkins | H02K 9/197 310/59 |
| 10,655,532 | B2 * | 5/2020 | Jacob | H02K 9/06 |
| 11,005,329 | B2 * | 5/2021 | Tolksdorf | H02K 5/18 |
| 11,973,381 | B2 * | 4/2024 | Shiromaru | F04C 23/02 |
| 12,060,799 | B2 * | 8/2024 | Himmelmann | H02K 7/1823 |
| 2017/0257007 | A1 * | 9/2017 | Braam | H02K 9/06 |

FOREIGN PATENT DOCUMENTS

| | | |
|---|---|---|
| CN | 203722413 | 7/2014 |
| CN | 108286523 | 7/2018 |
| DE | 8813030 U1 | 12/1988 |
| DE | 102018126775 | 4/2020 |

* cited by examiner

*Primary Examiner* — Jesse S Bogue

(74) *Attorney, Agent, or Firm* — Barnes & Thornburg LLP

(57) ABSTRACT

The invention relates to a fluid pump for conveying coolant. The fluid pump comprises an electric motor, a motor housing and an impeller. The motor has a shaft, a rotor, and a stator, and is inside an interior space in the motor housing. The impeller is connected to the shaft in the motor for conjoint rotation. The rotor has numerous blades on one side, which form a radial fan for conveying air inside the interior space.

14 Claims, 4 Drawing Sheets

FLUID PUMP

CROSS-REFERENCE TO RELATED APPLICATIONS

This application claims priority from German Patent Application No. DE 10 2023 200 129.2, filed on Jan. 10, 2023, the entirety of which is incorporated by reference herein.

The invention relates to a fluid pump for coolant according to the preamble of claim 1.

Fluid pumps are known from the prior art and normally comprise an impeller for conveying fluids and an electric motor for driving the impeller. Fluid pumps can be used for cooling a fuel cell system that contains at least one fuel cell stack composed of numerous fuel cells in a motor vehicle powered by fuel cells. The electric motor requires an effective cooling because of the high-powered hydraulics or electronics. Cooling the rotor and the stator therein is difficult.

It is therefore the object of the invention to create an improved or at least alternative design for a fluid pump of this type, that overcomes these disadvantages.

The present invention is based on the general idea of circulating air through the motor housing to cool the stator and rotor with a radial fan on the rotor.

The fluid pump according to the invention is designed for conveying coolant. The fluid pump can be designed in particular for cooling a fuel cell system that contains at least one stack of fuel cells comprising numerous fuel cells in a motor vehicle powered by fuel cells. The fluid pump has an electric motor with a shaft that rotates about a rotational axis, a rotor and a stator. The shaft is connected to the rotor for conjoint rotation, and can rotate with the rotor stator. The fluid pump also has a motor housing in which the motor is contained. The motor housing has a housing body with a wall that encompasses the rotational axis and a base that is transverse to the rotational axis.

The motor housing also has a lid that closes the housing body in the axial direction. The motor housing has an interior space filled with air that is sealed against the exterior, and the drive end of the shaft extends out of the interior space of the motor housing through the base of the housing body. The fluid pump also has an impeller unit that contains an impeller. The impeller in the impeller unit is connected to the drive end of the shaft in the electric motor for conjoint rotation. The rotor has numerous blades on one side according to the invention, which form a radial fan that causes the air inside the interior space to move.

The terms, "axial," "radial," and "circumferential" in the present invention are always in relation to the rotational axis of the shaft.

The blades of the radial fan are on the rotor. These blades can be on a side facing away from the impeller or on a side facing toward the impeller. In particular, the blades can be on just one side of the rotor. The side facing away from the impeller and the side facing toward the impeller are axially opposed to one another. The surfaces of the blades can be oriented in the axial direction, and the blades themselves can be oriented radially. The blades can also be evenly distributed about the rotational axis. Each of the blades can be a separate element that is permanently connected to the rotor. The blades can also form a single element that is permanently connected to the rotor. The radial fan can circulate the air in the interior space, thus cooling the rotor and stator. In particular, the permanent magnets in the rotor and the stator windings can be effectively cooled by this means. This increases the efficiency of the motor and the fluid pump on the whole.

There can be numerous cooling fins protruding into the interior space of the motor housing from the lid and/or base of the housing body. The cooling fins can be formed as integral parts of the lid and/or base, extending in the radial direction. The cooling fins increase the surface area of the lid and/or base, thus improving the heat exchange between the air in the interior space and the lid and/or base. This improves the cooling effect on the air in the interior space and consequently on the rotor and the stator.

In a first alternative, the blades of the radial fan can have counter-directional plates on their ends facing away from the rotor that are transverse to the rotational axis. These counter-directional plates can form an axial counter-directional surface that propels the air from the radial fan outward. This increases the air circulation in the interior space.

In another alternative, the lid on the motor housing can form a counter-directional surface for the blades of the radial fan. If there are numerous radial cooling fins on the lid that extend into the interior space, this counter-directional surface can be circular, and the cooling fins can transition radially into the counter-directional surface. In other words, the cooling fins can adjoin the counter-directional surface. The counter-directional surface is ideally axially opposite the blades of the radial fan and is flat.

Numerous axial cooling channels through which the air from the radial fan can flow can be formed in the rotor and/or stator. The air flowing in the interior space can then flow through these channels in the rotor and/or stator, thus cooling the rotor and/or stator. If the rotor is formed by a laminated cored with numerous permanent magnets, these cooling channels can be formed in the laminated core by holes passing axially through it. The axial holes also reduce the weight of the laminated core, and therefore the rotor. The cooling channels in the stator can be formed between the windings such that the air flowing in the interior space can flow over the windings, thus cooling them.

The motor housing can contain a cooling sleeve through which coolant can flow. The cooling sleeve can be formed by a double-layered part of the housing wall and a double-layered part of the lid. The double-layered part of the housing wall and the double-layered part of the lid have a fluid connection to one another through which coolant can flow. This ensures a more effective cooling of the stator where it is adjacent to the motor housing.

The impeller unit can have an impeller housing and the impeller housing can have an intake end with a fluid intake and an outlet end with a fluid outlet. The impeller can be contained in the impeller housing and form a fluid separation or connection between the intake end and the outlet end in the impeller housing. The cooling sleeve can have a fluid connection to the intake end and the outlet end, such that coolant can flow through it. The fluid connection between the cooling sleeve and the intake end and outlet end can pass through the base of the housing. There can be holes in the base of the housing body for this.

In particular, the cooling sleeve can contain numerous forward channels and one return channel in the double-layered part of the housing wall and a connecting channel in the double-layered part of the lid. The connecting channel can form a fluid connection between the forward channels and the return channel. The forward channels can have a fluid connection to the outlet end, or a high pressure end, and the return channel can have a fluid connection to the intake end or low pressure end, such that the coolant is conveyed through the cooling sleeve by the pressure difference between the intake end and the outlet end. The coolant can flow from the outlet end into the forward channels, from the forward channels into the connecting channel, from the connecting channel into the return channel, and from the return channel to the intake end. As described above, the forward channels can have a fluid connection to the outlet end and the return channel can have a fluid connection to the intake end through the base of the housing body. Hole can be formed through the base for this.

Coolant can flow around the base of the housing body inside the impeller housing, such that the base forms a heat exchanger for the air flowing in the interior space. Coolant can therefore flow over one side of the base, and the air flowing in the interior space can flow over the other side. Consequently, the air flowing in the interior space can be cooled by the coolant through the base. The double-layered part of the lid through which coolant flows can also form a heat exchanger for the air flowing in the interior space. In this case, the air flowing in the interior space can be cooled by the coolant through the double-layered part of the lid. As described above, numerous fins can be formed on the base and/or the lid that extend into the interior space to increase the heat exchange between the lid and/or the base and the air.

Other important features and advantages of the invention can be derived from the dependent claims, the drawings, and the descriptions of the drawings.

It should be clear that the features specified above and explained below can be used not only in the given combinations, but also in other combinations or in and of themselves, without abandoning the scope of the present invention.

Preferred exemplary embodiments of the invention are shown in the drawings and explained in greater detail below, in which the same reference symbols refer to the same or similar, or functionally similar, components.

Therein, schematically:

Figure 1:
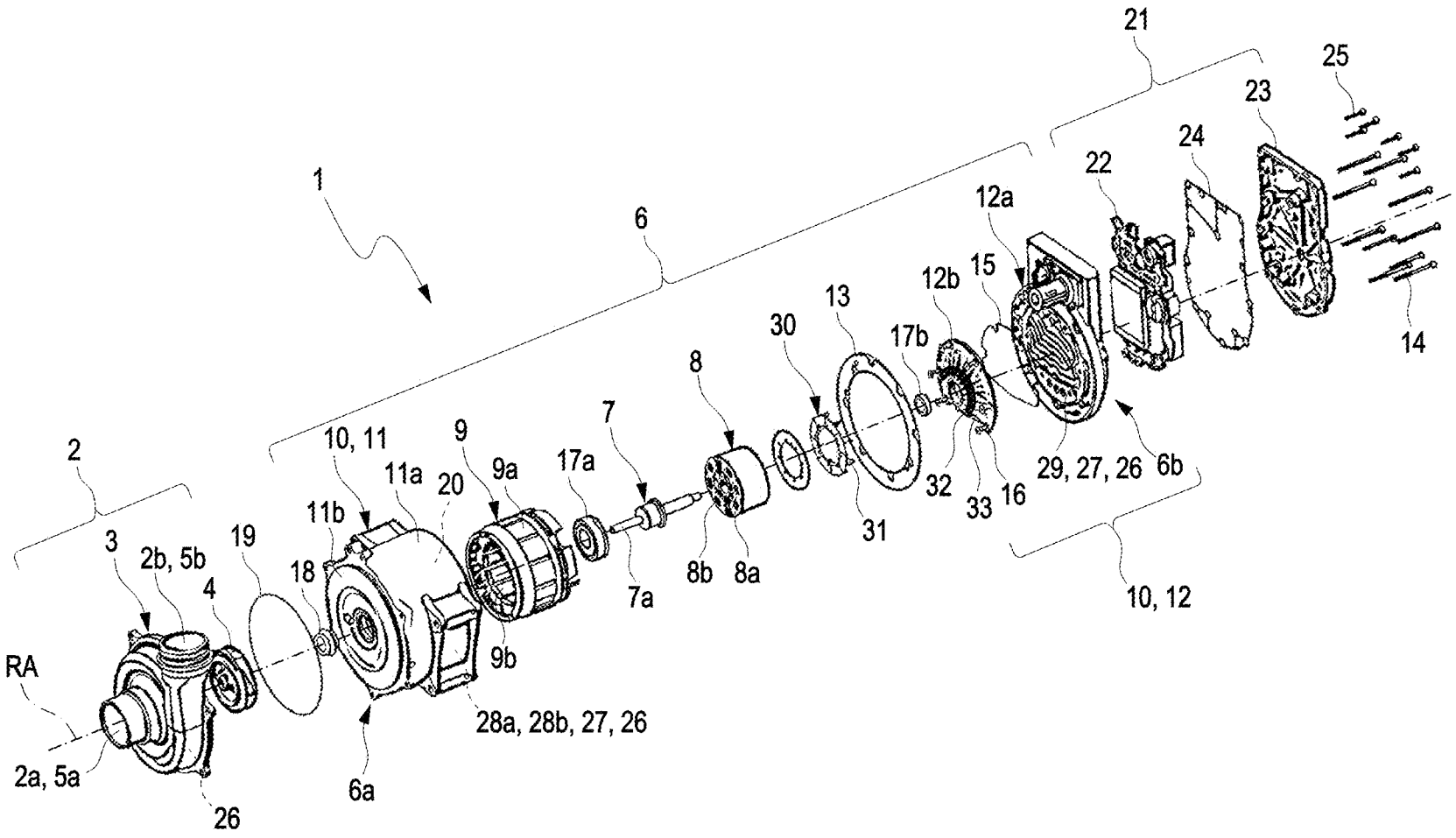
FIG. 1 shows an exploded view of a fluid pump according to the invention.

FIG. 1 shows an exploded view of a fluid pump 1 according to the invention. The fluid pump is intended or designed to convey coolant for a fuel cell system containing at least one stack of fuel cells comprising numerous fuel cells in a motor vehicle powered by fuel cells. The fluid pump 1 contains an impeller unit 2 comprising an impeller housing 3 and an impeller 4. The impeller unit 2 has an intake end 2*a*, or low-pressure end, which has a fluid intake 5*a*, and an outlet end 2*b*, or high-pressure end, which has a fluid outlet 5*b*. The impeller 4 can form a fluid separation or connection between the intake end 2*a* and outlet end 2*b*. The fluid intake 5*a* and fluid outlet 5*b* are formed in the impeller housing 3.

The fluid pump 1 also has an electric motor 6. The electric motor 6 can be a permanent magnet synchronous motor in particular. The motor 6 comprises a shaft 7 that can rotate about a rotational axis RA, a rotor 8 permanently attached to the shaft 7, and a stator 9 in which the rotor 8 is received. The rotor 8 comprises a laminated core 8*a* with numerous permanent magnets 8*b*. These permanent magnets 8*a* are distributed around the rotational axis RA and secured to the laminated core 8*a*. The stator 9 comprises a laminated core 9*a* and numerous stator windings 9*b*. The laminated core 9*a* forms a hollow cylinder and the stator windings 9*b* are distributed about the rotational axis RA within the laminated core 9*a*. The impeller 4 is connected to the drive end 7*a* of the shaft 7 for conjoint rotation, such that the impeller 4 rotates about the rotational axis RA with the shaft 7. The motor 6 has two opposing ends 6*a* and 6*b* in relation to the rotational axis RA. The impeller unit 2 is located at one end 6*a* of the motor 6.

The motor 6 also has a motor housing 10 formed by a cup-shaped body 11 with a lid 12 that is transverse to the rotational axis RA. The motor housing 10 also has a seal 13 that is clamped between the body 11 and the lid 12, that seals against the exterior. The housing body 11 and lid 12 are held together by numerous threaded fasteners 14. The housing body 11 has a wall 11*a* that encompasses the rotational axis RA and a base 11*b* that is transverse to the rotational axis RA. The base 11*b* separates the impeller 4 from the rotor 8 and stator 9 with regard to fluids that could otherwise flow therebetween. The drive end 7*a* of the shaft 7 extends through the base 11*a*, such that the impeller 4 is outside the motor housing 10. The lid 12 has a base plate 12*a* and a cover plate 12*b* covers the base plate 12*a* where it faces toward the stator, rotor, and impeller. There is a seal 15 clamped between the base plate 12*a* and the cover plate 12*b*, which seals against the exterior. The base plate 12*a* and cover plate 12*b* are held together by numerous threaded fasteners 16.

The shaft 7 has an impeller seal 18 at the one end 6*a*. The fluid pump 1 also has a shaft seal 19. The shaft seal 19 is clamped between the motor housing 10 and the impeller housing 3, and seals against the exterior.

An interior space 20 filled with air is formed in the motor housing 10, in which the stator 9 and rotor 8 are located. The stator 9 is stationary in the motor housing 10, and the shaft 7 can rotate with the rotor 8 in the motor housing 10, or in the stator 9. The fluid pump 1 has two bearings 17*a* and 17*b* that support the shaft 7 at the ends 6*a* and 6*b* of the motor 6 such that it can rotate therein.

The fluid pump 1 also contains an inverter 21 with which electricity is supplied to the motor 6. The inverter 21 can convert DC voltages between 400 V and 900 V. The inverter is located on the lid 12 at the second end 6*b* of the motor 6. The inverter 21 comprises a control circuit board 22 and an inverter lid 23, with the control circuit board 22 being between the lid 12, or base plate 12*a* of the motor housing 10, and the inverter lid 23, facing away from the impeller unit 2, on the outside thereof. The inverter 21 also has a seal 24 clamped between the lid 12, or base plate 12*a*, and the inverter lid 23, which seals against the exterior. The lid 12, or base plate 12, and the inverter lid 23 are held together by numerous threaded fasteners 25.

The fluid pump 1 is designed to convey coolant. The fluid pump 1 has a channel 26 for this that passes through the impeller 4 from the fluid intake 5*a* at the intake end 2*a* to the fluid outlet 5*b* at the outlet end 2*b*. Parts of this channel 26 are also formed by cooling sleeve 27 in the motor housing 10. The cooling sleeve 27 comprises numerous—seven in this case—forward channels 28*a* and a return channel 28*a* in the wall of the housing 11*a* and a meandering or mazelike connecting channel 29 formed in the lid 12 between the base plate 12*a* and the cover plate 12*b*. The cooling sleeve 27 is delimited toward the exterior by the motor housing 10, and the coolant does not come in direct contact with the rotor 8 of the stator 9. The coolant itself can be dielectric. The structure of the channel 26 and of the cooling sleeve 27 shall be explained in greater detail below, in reference to FIG. 2.

The fluid pump 1 also has a radial fan 30 on the rotor, facing away from the impeller 4 in this case. The radial fan 30 is designed to propel air through the interior space 20 in the motor housing 10. The radial fan 30 has numerous blades 31 that cause the air to move when the rotor 8 rotates, thus cooling the rotor 8 and the stator 9. A counter-directional surface 32 for the blades 31 in the radial fan 30 is formed on the lid 12, or the cover plate 12*b*. The counter-directional surface 32 is circular and reinforces the radial movement of the air when the radial fan 30 is rotating. There are also numerous radial cooling fins 33 on the lid 12, or cover plate 12*b*, that extend into the interior space 20, which cool the air in the interior space 20. The cooling fins 33 transition into the counter-directional surface 32. The structure of the radial fan 30 and its functioning shall be explained in greater detail below, in reference to FIG. 4.

Figure 2:
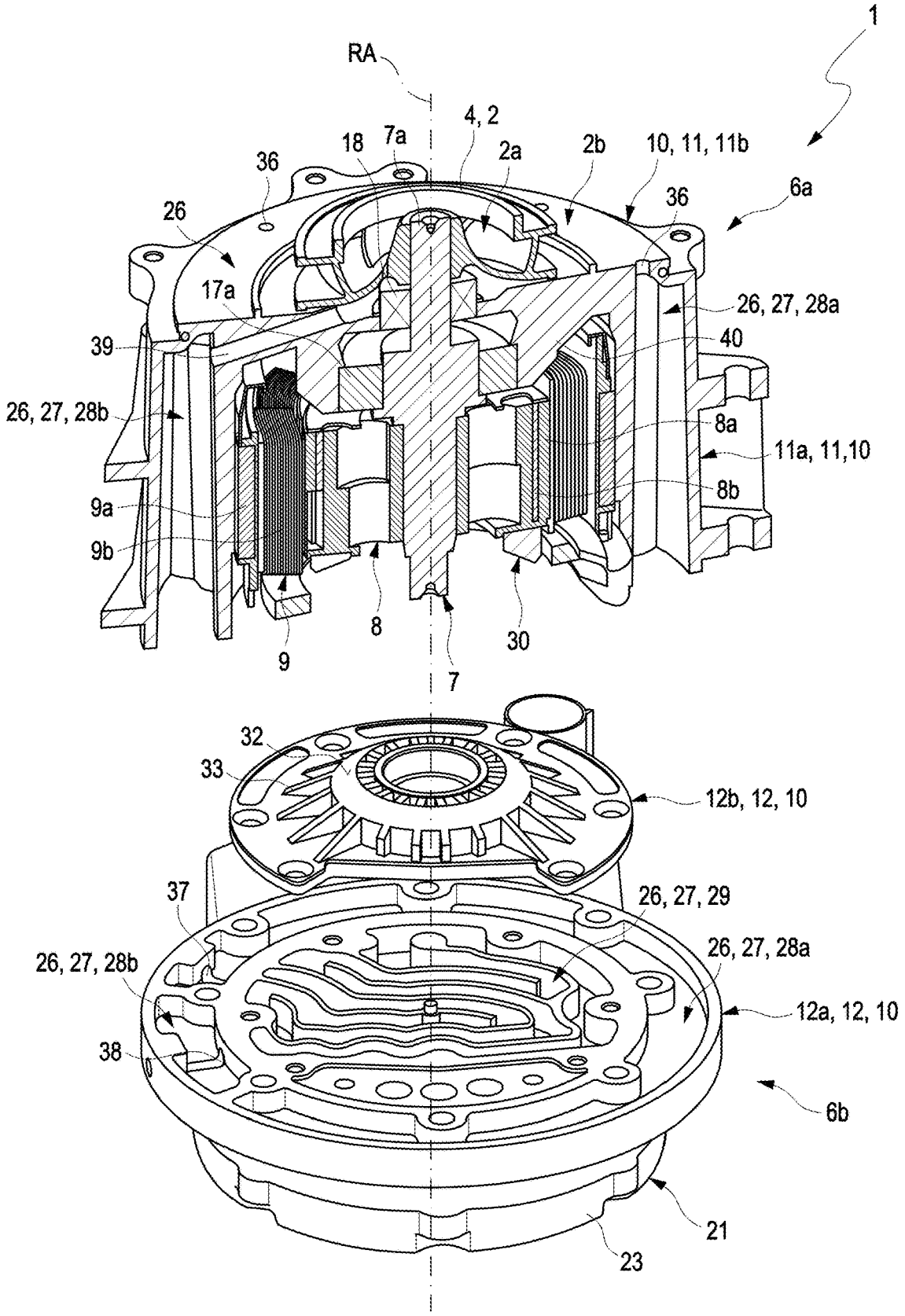
FIG. 2 shows a partially exploded view of the fluid pump according to the invention, with a partial cutaway.

FIG. 2 shows a partially exploded view of the fluid pump 1 according to the invention, in a partial cutaway. The impeller housing 3 is not shown here for purposes of clarity. As described above, the channel 26 connects the intake end 2*a*, or low pressure end, of the impeller unit 2 to the outlet end 2*b*, or high pressure end, of the impeller unit 2 through the impeller 4. The impeller 4 is connected to the drive end 7*a* of the shaft 7 for the motor 6, and conveys coolant from the intake end 2*a* to the outlet end 2*b*. The intake end 2*a* is therefore inside the impeller 4, and the outlet end 2*b* is therefore on the circumference of the impeller 4. Part of the channel 26 is also formed by the cooling sleeve 27. The cooling sleeve 27 comprises numerous—seven in this case—forward channels 28*a*, the return channel 28*b*, and the connecting channel 29, and is formed inside the housing wall 11*a* and the base plate 12*a* of the lid 12.

The various forward channels 28*a* are formed in the housing body 11 and the base plate 12*a* for the lid 12. The forward channels 28*a* have a fluid connection to the outlet end 2*b* of the impeller unit 2 via an intake hole 36, which is formed in the base 11*b* of the housing body 11. The forward channels 28*a* extend axially, or parallel to the rotational axis RA, in the housing wall 11*a*, and their cross sections taper from the first end 6*a* to the second end 6*b* of the motor 6. The numerous forward channels 28*a* are distributed about the rotational axis RA in the housing body 11, and have fluid connections to one another inside the housing body 11 and the lid 12 at bypass points. The forward channels 28*a* are parallel to one another in the housing body 11 and fluid can flow through them axially in relation to the rotational axis RA. The numerous forward channels 28*a* are formed in the base plate 12*a* of the lid 12 where the housing body 11 and the lid 12, or the housing wall 11 and the base plate 12*a* of the lid 12, intersect. The cover plate 12*b* of the lid 12 is outside this intersecting region and therefore outside the housing body 11, or housing wall 11*a*.

The meandering, or mazelike, connecting channel 29 is formed in the lid 12 between the base plate 12*a* and the cover plate 12*b*. The connecting channel 29 has a fluid connection to the numerous forward channels 28*a* at an intake point 37 and the return channel 28*b* at an outlet point 38. The connecting channel 29 is formed in the middle of the base plate 12*a* and the cover plate 12*b* partially closes the base plate 12*a* and in the middle. The numerous connecting channels 28*a* encircle the connecting channel 29 in the base plate 12*a*.

The return channel 28*b* is formed in the housing body 11 and in the base plate 12*a* of the lid 12. The return channel 28*b* has a fluid connection to the intake end 2*a* of the impeller unit 2 through an outlet hole 39 in the base 11*b* of the housing body 11. The return channel 29 extends axially, or parallel to the rotational axis RA, in the housing wall 11*a*, and its cross section tapers from the first end 6*a* to the second end 6*b* of the motor 6. The return channel 28*b* has a fluid connection to the connecting channel 29 at the outlet point 38 in the base plate 12*a* of the lid 12.

The coolant is conveyed in the fluid pump 1 by the impeller from the fluid intake 5*a* on the intake end 2*a* to the fluid outlet 5*b* on the outlet end 2*b*. A portion of the coolant flows out of the fluid pump 1 from the outlet end 2*b* through the fluid outlet 5*b*, an a portion of the coolant flows into the cooling sleeve 27. In the cooling sleeve 27, the coolant is conveyed through the intake holes 36 into the forward channels 28*a* and then to the connecting channel 29. The coolant than enters the connecting channel 29 at the intake point 37 and flows to the outlet point 38. The coolant then flows at the outlet point 38 into the return channel 28*b*, through the return channel 28*b*, and then to the intake end 2*a* through the outlet hole 39. The coolant is then conveyed by the impeller 4 again from the intake end 2*a*, along with the coolant flowing into the fluid pump 1 through the fluid intake 5*a*, to the outlet end 2*b*.

Figure 3:
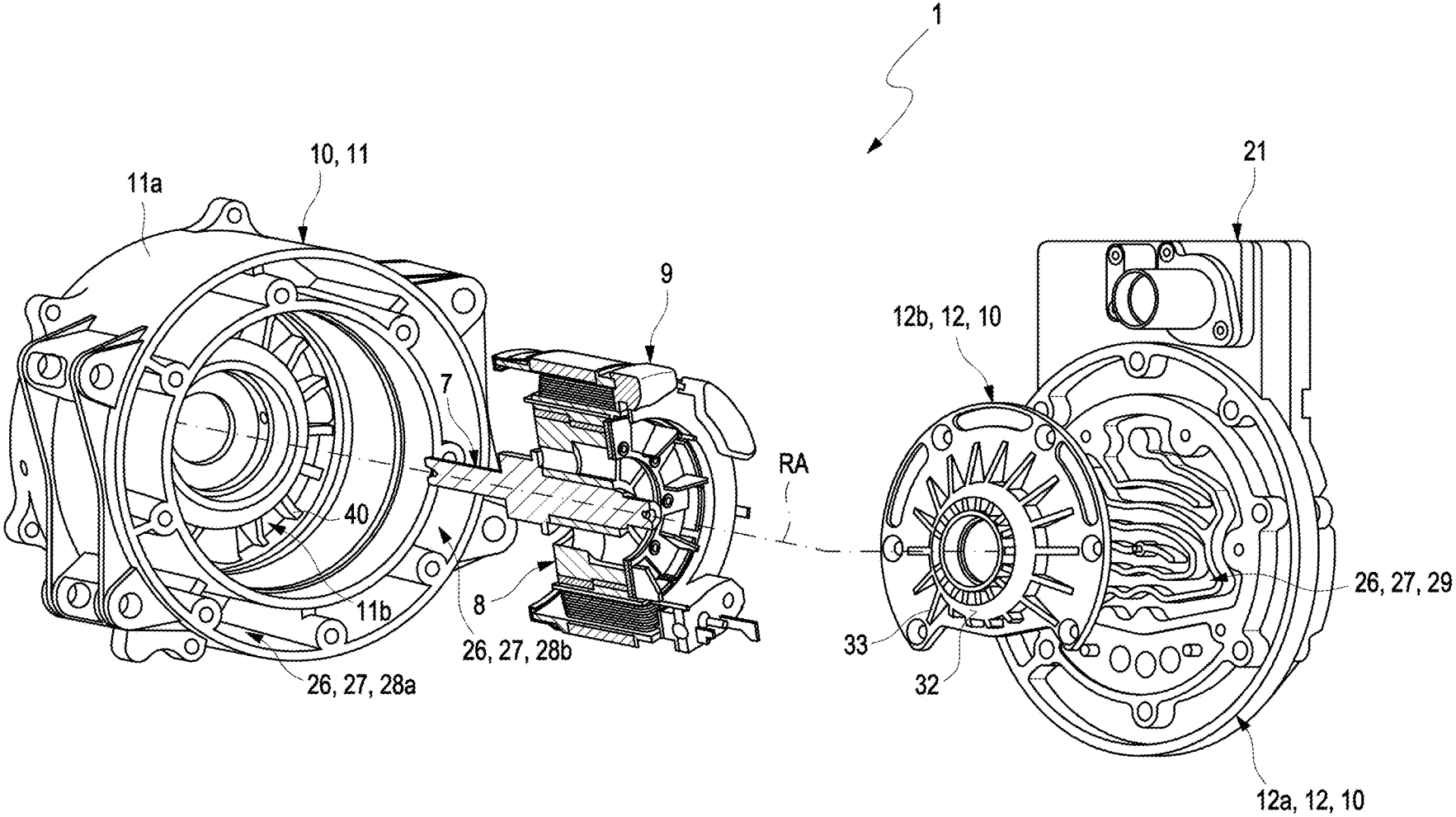
FIG. 3 shows another partially exploded view of the fluid pump according to the invention, with a partial cutaway.

FIG. 3 shows another partially exploded view of the fluid pump 1 according to the invention 1, with a partial cutaway. Numerous radial cooling fins 40 can be seen here on the base 11*b* of the housing body 11, which extend into the interior space 20 in the motor housing.

Figure 4:
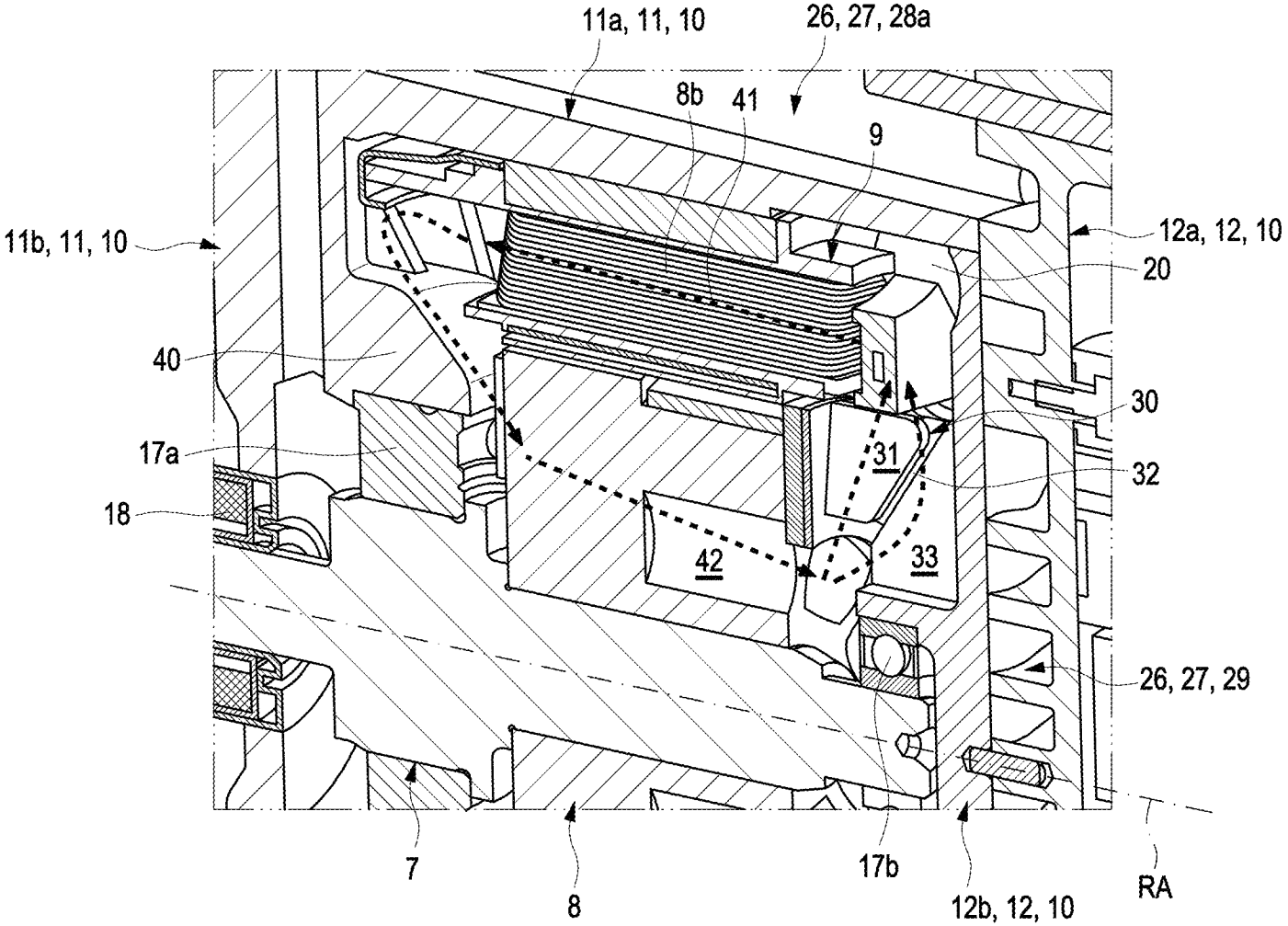
FIG. 4 shows a sectional view of the fluid pump according to the invention where the motor housing forms an interior space.

FIG. 4 shows a sectional view of the fluid pump 1 according to the invention where the interior space 20 is formed in the motor housing 10. The interior space 20 is filled with air circulated by the radial fan 30, as indicated by the arrows. The blades 31 of the fan 30 rotate with the rotor 8, such that the air is pushed radially outward. The air thus flows over the cover plate 12*b* of the lid 12. Coolant in the connecting channels 29 therefore flows over one side of the cover plate 12*b*, such that the air above the cover plate 12*b* exchanges heat with the coolant and is therefore cooled. The cooling fins 33 formed on the cover plate 12*b* also contribute to the heat exchange. The air cooled at the cover plate 12*b* then flows through the numerous cooling channels 41 formed between the winding 9*b* in the stator 9, axially to the base 11*b* of the housing body 11, and cools the windings 9*b* in the stator 9. Coolant flows over the base 11*b* at the impeller side, such that the air above the base 11*b* exchanges heat with the coolant and is therefore cooled. The air cooled at the base 11*b* subsequently flows through numerous cooling channels 42 formed in the rotor 8, back to the radial fan 30, and thus cools the rotor 8.

The specification can be readily understood with reference to the following Numbered Paragraphs:

Numbered Paragraph 1. A fluid pump (1) for conveying coolant, wherein the fluid pump (1) contains an electric motor (6) with a shaft (7) that can rotate about a rotational axis (RA), a rotor (8) and a stator (9), wherein the shaft (7) is connected to the rotor (8) for conjoint rotation, and the shaft (7) can rotate with the rotor (8) in the stator (9), wherein the fluid pump (1) has a motor housing (10), and the motor (6) is contained in the motor housing (10), wherein the motor housing (10) has a housing body (11) with a housing wall (11*a*) encompassing the rotational axis (RA), and a base (11*a*) that is transverse to the rotational axis (RA), and a lid (12) that closes the housing body (11) axially, wherein the motor housing (10) has an interior space (20) filled with air that is sealed against fluids, and a drive end (7*a*) of the shaft (7) extends out of the interior space (20) in the motor housing (10) through the base (11*b*) of the housing body (11), and wherein the fluid pump (1) has an impeller unit (2) with an impeller (4), and the impeller (4) in the impeller unit (2) is connected to the drive end (7*a*) of the shaft (7) of the motor (6) for conjoint rotation, characterized in that the rotor (8) has numerous blades (31) on one side, and the blades (31) form a radial fan (30) for conveying air inside the interior space (20).

Numbered Paragraph 2. The fluid pump (1) according to Numbered Paragraph 1, characterized in that the motor housing (10) has numerous cooling ribs (33) protruding into the interior space (20) on the lid (12), and/or the motor housing (10) has numerous cooling ribs (33) protruding into the interior space on the base (11*b*) of the housing body 11).

Numbered Paragraph 3. The fluid pump (1) according to Numbered Paragraph 1 or 2, characterized in that each of the blades (31) of the radial fan (30) has a counter-directional plate on the end facing away from the rotor (8) that is transverse to the rotational axis (RA).

Numbered Paragraph 4. The fluid pump (1) according to Numbered Paragraph 1 or 2, characterized in that the lid (12) on the motor housing (10) forms a counter-directional surface (32) for the blades (31) of the impeller (4).

Numbered Paragraph 5. The fluid pump (1) according to Numbered Paragraph 4, characterized in that the motor housing (10) has numerous radial cooling fins (33) protruding into the interior space (20), and the counter-directional surface (32) is circular and the cooling fins (33) transition radially into the counter-directional surface (32).

Numbered Paragraph 6. The fluid pump (1) according to any of the preceding Numbered Paragraphs, characterized in that numerous axial cooling channels (42) are formed in the rotor (8) through which the air conveyed by the radial fan (30) flows, and/or numerous axial cooling channels (41) are formed in the stator (9), through which the air conveyed by the radial fan (30) flows.

Numbered Paragraph 7. The fluid pump (1) according to any of the preceding Numbered Paragraphs, characterized in that the motor housing (10) has a cooling sleeve (27), wherein part of the cooling sleeve (27) is formed by a double-layered part of the housing wall (11*a*) of the housing body (11), and a double-layered part of the lid (12).

Numbered Paragraph 8. The fluid pump (1) according to Numbered Paragraph 7, characterized in that the impeller unit (2) has an impeller housing (3) and the impeller housing (3) has an intake end (2*a*) with a fluid intake (5*a*) and an outlet end (2*b*) with a fluid outlet (5*b*), the impeller (4) is contained in the impeller housing (3), and the intake end (2*a*) and outlet end (2*b*) are separated from one another inside the impeller housing (3), the cooling sleeve (27) has a fluid connection to the intake end (2*a*) and the outlet end (2*b*), such that coolant can flow therethrough.

Numbered Paragraph 9. The fluid pump (1) according to Numbered Paragraph 8, characterized in that coolant can flow over the base (11*a*) of the housing body (11) inside the impeller housing (3), thus forming a heat exchanger for the air flowing in the interior space (20).

Numbered Paragraph 10. The fluid pump (1) according to any of the Numbered Paragraphs 7 to 9, characterized in that the double-layered part of the lid (12) through which coolant flows forms a heat exchanger for the air flowing in the interior space (20).

The invention claimed is:

1. A fluid pump for conveying coolant, wherein the fluid pump comprises an electric motor with a shaft that can rotate about a rotational axis (RA), a rotor and a stator, wherein the shaft is connected to the rotor for conjoint rotation, and the shaft can rotate with the rotor in the stator, wherein the fluid pump comprises a motor housing, and the motor is contained in the motor housing, wherein the motor housing comprises a housing body with a housing wall encompassing the rotational axis (RA), and a base that is transverse to the rotational axis (RA), and a lid that closes the housing body axially, wherein the motor housing comprises an interior space filled with air that is sealed against fluids, and a drive end of the shaft extends out of the interior space in the motor housing through the base of the housing body, and wherein the fluid pump comprises an impeller unit with an impeller, and the impeller in the impeller unit is connected to the drive end of the shaft of the motor for conjoint rotation, wherein the rotor has numerous blades on one side, and the blades form a radial fan for conveying air inside the interior space, wherein the lid on the motor housing forms a counter-directional surface for the blades of the impeller, and wherein the motor housing comprises numerous radial cooling fins protruding into the interior space, and the counter-directional surface is circular and the cooling fins transition radially into the counter-directional surface.

2. The fluid pump according to claim 1, wherein each of the blades of the radial fan comprises a counter-directional plate on an end thereof facing away from the rotor that is transverse to the rotational axis (RA).

3. The fluid pump according to claim 1, wherein the motor housing comprises a plurality of cooling ribs that protrude into the interior space on the lid, and/or the motor housing comprises a plurality of cooling ribs that protrude into the interior space on the base of the housing body.

4. The fluid pump according to claim 1, wherein each of the blades of the radial fan comprises a counter-directional plate on an end thereof facing away from the rotor that is transverse to the rotational axis (RA).

5. The fluid pump according to claim 1, wherein numerous axial cooling channels are formed in the rotor through which the air conveyed by the radial fan flows, and/or numerous axial cooling channels are formed in the stator, through which the air conveyed by the radial fan flows.

6. The fluid pump according to claim 1, wherein the motor housing comprises a cooling sleeve, wherein part of the cooling sleeve is formed by a double-layered part of the housing wall of the housing body, and a double-layered part of the lid.

7. The fluid pump according to claim 6, wherein the impeller unit comprises an impeller housing and the impeller housing comprises an intake end with a fluid intake and an outlet end with a fluid outlet, the impeller is contained in the impeller housing, and the intake end and outlet end are separated from one another inside the impeller housing, the cooling sleeve comprises a fluid connection to the intake end and the outlet end, such that coolant can flow therethrough.

8. The fluid pump according to claim 7, wherein coolant can flow over the base of the housing body inside the impeller housing, thus forming a heat exchanger for the air flowing in the interior space.

9. The fluid pump according to claim 6, wherein the double-layered part of the lid through which coolant flows forms a heat exchanger for the air flowing in the interior space.

10. A fluid pump for conveying coolant, wherein the fluid pump comprises an electric motor with a shaft that can rotate about a rotational axis (RA), a rotor and a stator, wherein the shaft is connected to the rotor for conjoint rotation, and the shaft can rotate with the rotor in the stator, wherein the fluid pump comprises a motor housing, and the motor is contained in the motor housing, wherein the motor housing comprises a housing body with a housing wall encompassing the rotational axis (RA), and a base that is transverse to the rotational axis (RA), and a lid that closes the housing body axially, wherein the motor housing comprises an interior space filled with air that is sealed against fluids, and a drive end of the shaft extends out of the interior space in the motor housing through the base of the housing body, and wherein the fluid pump comprises an impeller unit with an impeller, and the impeller in the impeller unit is connected to the drive end of the shaft of the motor for conjoint rotation, wherein the rotor has numerous blades on one side, and the blades form a radial fan for conveying air inside the interior space;

wherein the motor housing comprises a cooling sleeve, wherein part of the cooling sleeve is formed by a double-layered part of the housing wall of the housing body, and a double-layered part of the lid;

wherein the impeller unit comprises an impeller housing and the impeller housing comprises an intake end with a fluid intake and an outlet end with a fluid outlet, the impeller is contained in the impeller housing, and the intake end and outlet end are separated from one another inside the impeller housing, and the cooling sleeve comprises a fluid connection to the intake end and the outlet end, such that coolant can flow therethrough.

11. The fluid pump according to claim 10, wherein coolant can flow over the base of the housing body inside the impeller housing, thus forming a heat exchanger for the air flowing in the interior space.

12. The fluid pump according to claim 10, wherein the double-layered part of the lid through which coolant flows forms a heat exchanger for the air flowing in the interior space.

13. The fluid pump according to claim 10, wherein the motor housing comprises a plurality of cooling ribs that protrude into the interior space on the lid, and/or the motor housing comprises a plurality of cooling ribs that protrude into the interior space on the base of the housing body.

14. The fluid pump according to claim 10, wherein numerous axial cooling channels are formed in the rotor through which the air conveyed by the radial fan flows, and/or numerous axial cooling channels are formed in the stator, through which the air conveyed by the radial fan flows.

* * * * *